US005762337A

United States Patent [19]

Poisson

[11] Patent Number: 5,762,337

[45] Date of Patent: Jun. 9, 1998

[54] APPARATUS AND METHOD OF PLAYING A BASEBALL BOARD GAME

[75] Inventor: Renald Poisson, Houston, Tex.

[73] Assignee: Clutch Games, Inc., Houston, Tex.

[21] Appl. No.: 695,307

[22] Filed: Aug. 9, 1996

[51] Int. Cl.[6] ..... A63F 3/00

[52] U.S. Cl. ..... 273/244.2; 273/298

[58] Field of Search ..... 273/298, 244.2, 273/259, 277

[56] References Cited

U.S. PATENT DOCUMENTS

| | | | |
|---|---|---|---|
| 1,177,677 | 4/1916 | Beam | 273/298 |
| 1,547,313 | 7/1925 | Foster | 273/244.2 |
| 1,684,189 | 9/1928 | Meyer | 273/244.2 |
| 2,742,290 | 4/1956 | Fasana | 273/244.2 |
| 2,788,213 | 4/1957 | Hull | 273/244.2 |

*Primary Examiner*—Benjamin H. Layno

[57] ABSTRACT

A method for playing a baseball board game using a first deck of cards and a second deck of cards and shuffling the first deck of cards with the second deck of cards to produce a playing deck. The first deck of cards comprises baseball offense cards and baseball defense cards. A third deck having a plurality of pitch cards and a plurality of situational play cards is also used. A game board resembling the shape of a baseball field is provided. The game board has game pieces representing batters and base runners and markers to record strikes, balls, and outs. A tabular means to record strikes, balls, outs, runs and innings is provided. At least a portion of the plurality of cards carries instructions for their use to replicate the progress of a baseball game.

47 Claims, 10 Drawing Sheets

FIG. 3A

| | | |
|---|---|---|
| GROUND BALL HIT<br>SINGLE<br>RUNNER(S) ADVANCE(S) 1 BASE<br>(CAN ONLY BE BE PLAYED)<br>(ON SINKER OR SLIDER)<br>5 | GROUND BALL HIT<br>INFIELD HIT<br>BATTER SAFE AT 1ST<br>RUNNER HELD AT 2ND<br>(CAN ONLY BE BE PLAYED)<br>(ON CHANGE-UP OR SCREW BALL)<br>(CAN ONLY HAVE MAN ON 2ND)<br>6 | GROUND BALL HIT<br>INFIELD HIT<br>BATTER SAFE AT 1ST<br>RUNNER HELD AT 3RD<br>(CAN ONLY BE BE PLAYED)<br>(ON CHANGE-UP OR SCREW BALL)<br>(CAN ONLY HAVE MAN ON 3RD)<br>6' |
| GROUND BALL HIT<br>DRAG BUNT<br>BATTER SAFE AT 1ST<br>RUNNER(S) ADVANCE(S) 1 BASE<br>(CAN ONLY BE BE PLAYED)<br>(ON CHANGE-UP OR SCREW BALL)<br>8 | GROUND BALL HIT<br>BASE HIT<br>RUNNER(S) ADVANCE(S) 1 BASE<br>(CAN ONLY BE PLAYED)<br>(ON SINKER, SLIDER,)<br>(CHANGE-UP OR SCREW BALL)<br>10 | GROUND BALL HIT<br>BASE HIT<br>BATTER GOES TO 1ST<br>LEAD RUNNER(S) ADVANCE(S) 2 BASES<br>(CAN ONLY BE PLAYED)<br>(ON SINKER, SLIDER,)<br>(CHANGE-UP OR SCREW BALL)<br>10' |
| GROUND BALL HIT<br>DOUBLE<br>RUNNER(S) ADVANCE(S) 2 BASES<br>(CAN ONLY BE BE PLAYED)<br>(ON SINKER, SLIDER,)<br>(CHANGE-UP OR SCREW BALL)<br>12 | GROUND BALL HIT<br>DOUBLE<br>RUNNER ADVANCES 3 BASES<br>(WHEN ONLY RUNNER IS ON 1ST)<br>(CAN ONLY BE PLAYED)<br>(ON SINKER, SLIDER,)<br>(CHANGE-UP OR SCREW BALL)<br>12' | LONG FLY HIT<br>BASE HIT<br>"TEXAS LEAGUER"<br>RUNNER(S) ADVANCE(S) 1 BASE<br>(CAN ONLY BE BE PLAYED)<br>(ON CURVE BALL)<br>14 |

FIG. 6A

| | | |
|---|---|---|
| STEAL<br>RUNNER<br>STEALS ANY BASE<br>(CAN ONLY BE BE PLAYED)<br>(ON CURVE BALL)<br>(THE PITCH IS A BALL IF SAFE)<br>(CAN ONLY HAVE ONE MAN ON BASE)<br>(CAN ONLY STEAL HOME WITH 2 OUTS)<br>X<br>54 | STEAL<br>RUNNER ON 1ST<br>STEALS 2ND BASE<br>(CAN ONLY BE BE PLAYED)<br>(ON CHANGE-UP)<br>(THE PITCH IS A STRIKE IF SAFE)<br>(CAN ONLY HAVE ONE MAN ON BASE)<br>X<br>54' | STEAL<br>RUNNER ON 2ND<br>STEALS 3RD BASE<br>(CAN ONLY BE BE PLAYED)<br>(ON SCREW BALL)<br>(THE PITCH IS A STRIKE IF SAFE)<br>(CAN ONLY HAVE ONE MAN ON BASE)<br>X<br>54'' |
| DOUBLE STEAL OUT<br>LEAD RUNNER OUT<br>ON DOUBLE STEAL<br>X<br>56 | OUT STEALING<br>RUNNER OUT<br>STEALING ANY BASE<br>X<br>58 | OUT STEALING<br>RUNNER OUT<br>STEALING 2ND BASE<br>X<br>58' |
| OUT STEALING<br>RUNNER OUT<br>STEALING 3RD BASE<br>X<br>58'' | DOUBLE STEAL<br>RUNNERS<br>STEAL ANY 2 BASES<br>X<br>60 | SACRIFICE HIT<br>RUNNER(S) ADVANCE(S)<br>BATTER OUT AT 1ST BASE<br>(CAN NOT BE BE PLAYED)<br>(ON FAST BALL OR CURVE BALL)<br>X<br>62 |

FIG. 6B

| | | |
|---|---|---|
| SACRIFICE BUNT | RUNNER(S) ADVANCE(S)<br>BATTER OUT AT 1ST BASE<br>(CAN NOT BE BE PLAYED)<br>(ON FAST BALL OR CURVE BALL)<br>X | 62 |
| HIT BATSMAN | BATTER ADVANCES TO 1ST BASE<br>(CAN BE PLAYED ON ANY PITCH)<br>X | 64 |
| WILD PITCH | RUNNER(S) ADVANCE(S) ONE BASE<br>(CAN NOT BE BE PLAYED)<br>(ON FAST BALL OR CHANGE-UP)<br>(THE PITCH IS A BALL)<br>X | 66 |
| PAST BALL | RUNNER(S) ADVANCE(S) ONE BASE<br>(CAN NOT BE PLAYED)<br>(ON CURVE BALL OR CHANGE-UP)<br>(THE PITCH IS A STRIKE)<br>X | 68 |
| DOUBLE PLAY | RUNNERS ARE OUT AT 1ST AND 2ND BASE<br>(CAN ONLY BE BE PLAYED)<br>(ON GROUND BALL HIT)<br>X | 70 |
| DOUBLE PLAY | BATTER IS OUT AND MAN ON 1ST IS DOUBLED UP<br>(CAN ONLY BE BE PLAYED)<br>(ON LINE DRIVE HIT)<br>X | 70' |
| INFIELD ERROR | BATTER SAFE AT 1ST RUNNER(S) ADVANCE(S) ONE BASE<br>(CAN NOT BE PLAYED)<br>(ON FAST BALL OR CURVE BALL)<br>X | 72 |
| 2 BASE ERROR | BATTER GOES TO 2ND RUNNER(S) ADVANCE(S) TWO BASES<br>(CAN ONLY BE PLAYED)<br>(ON FAST BALL OR CURVE BALL)<br>X | 72' |
| OUTFIELD ERROR | BATTER SAFE AT 1ST RUNNER(S) ADVANCE(S) ONE BASE<br>(CAN ONLY BE PLAYED)<br>(ON CURVE BALL OR CHANGE-UP)<br>X | 72'' |

APPARATUS AND METHOD OF PLAYING A BASEBALL BOARD GAME

BACKGROUND OF THE INVENTION

This invention relates to a baseball board game. More specifically, this invention relates to a baseball board game that closely follows how major league baseball games are played.

OBJECTS OF THE INVENTION

It is an object of the present invention to provide a baseball board game that is similar to the major league game of baseball that can be played in an intimate setting.

It is another object of the present invention to provide a baseball board game that incorporates the key elements of popular card games like; the finesse of bridge, the bluffing of poker, the card counting concept of pinnocle, and the confrontation of battle or war.

It is another object of the present invention to provide a board game that is self-sustaining in that the game uses no dice, spinners, statistics or mechanical devices to depict the outcome of the game.

SUMMARY OF THE INVENTION

In one embodiment of the present invention there is provided a method for playing a baseball board game. The method comprises providing a first deck of cards and a second deck of cards and shuffling the first deck of cards with the second deck of cards to produce a playing deck. A like plurality of cards are then dealt from the playing deck to each of a first player and a second player. The first deck of cards comprises baseball offense cards and baseball defense cards.

The baseball offense cards comprise baseball offense hit cards and baseball offense call cards. The baseball offense hit cards are selected from the group consisting of: ground ball single, ground ball infield hit cards, ground ball drag bunt, ground ball base hit, ground ball double cards, long fly base hit cards, long fly double, long fly triple, long fly home run, line drive base hit, line drive double, line drive triple, and line drive home run. The baseball offense call card is a ball card.

The baseball defense cards are selected from defense play cards and defense call cards. The defense play cards are selected from the group consisting of: ground ball out, long fly out, and line drive out. The defense call cards being selected from the group consisting of: foul ball call, and strike.

A beginning baseball offense player and a beginning baseball defense player are declared and a plurality of cards are dealt from a third deck to the baseball offense player and the baseball defense player. The third deck comprises a pitch cards and a situational play cards. The pitch cards are selected from the group consisting of: fast ball, curve ball, sinker, change-up, slider, and screw ball. The situational play cards being selected from the group consisting of: steal, out stealing, double steal, double steal out, sacrifice, hit batsman, wild pitch, past ball, double play, error, hit and run, suicide squeeze, balk, pinch hit, intentional walk, and pinch hit out.

A pitch card is played by the baseball defense player. A second card is then played responsively to the first card by the offense player. A replacement card is drawn for the second card from the playing deck by the offense player. The defense player elects whether to permit an outcome indicated by the second card to stand and discard a discard card or to play a third card responsively to the second card. A replacement card is drawn by the defense player for the discard card or third card.

DETAILED DESCRIPTION OF THE PREFERRED EMBODIMENTS

Figure 3B:
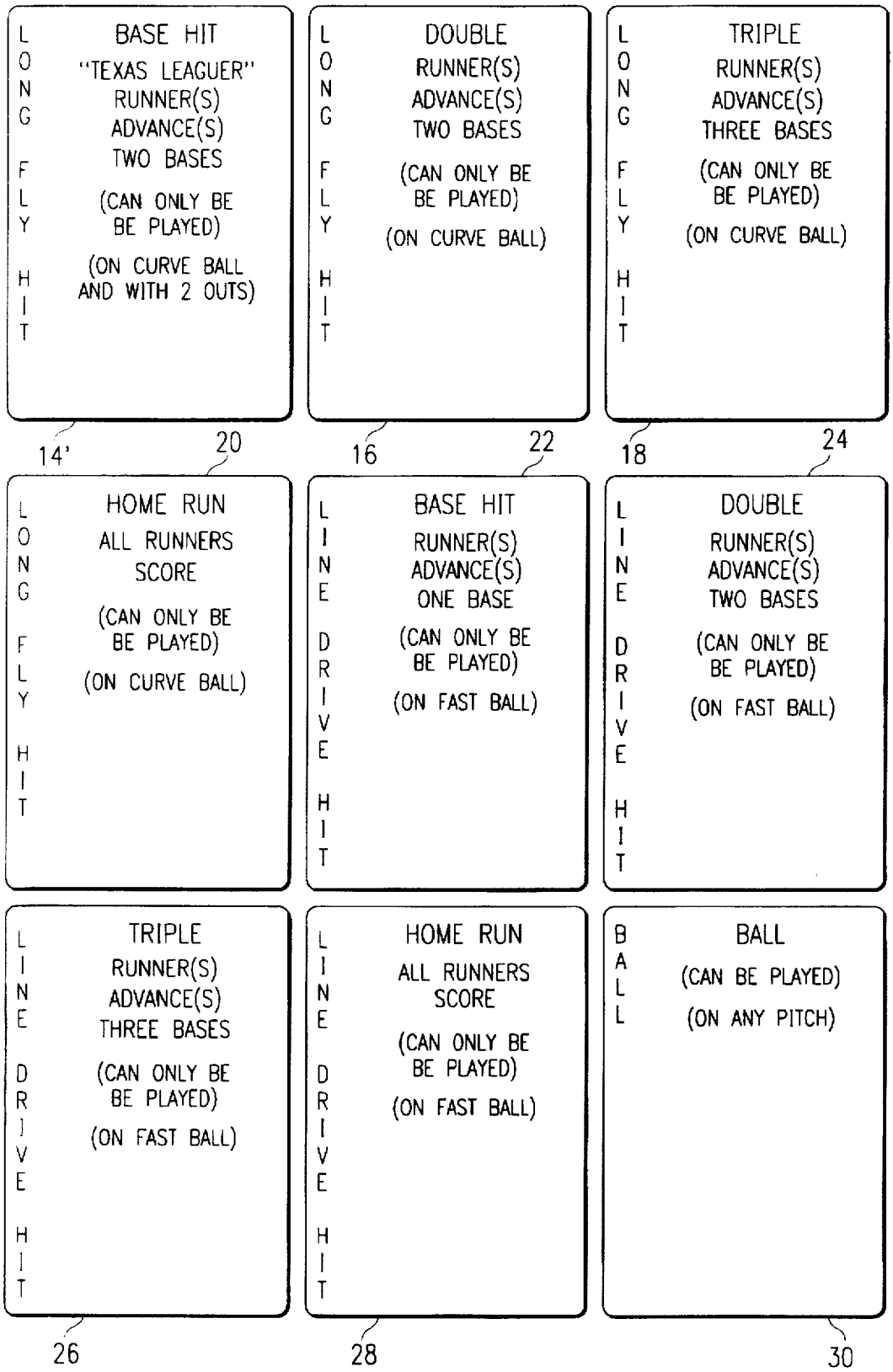
FIG. 3 is a pictorial view of the baseball offense cards.
Figure 4:
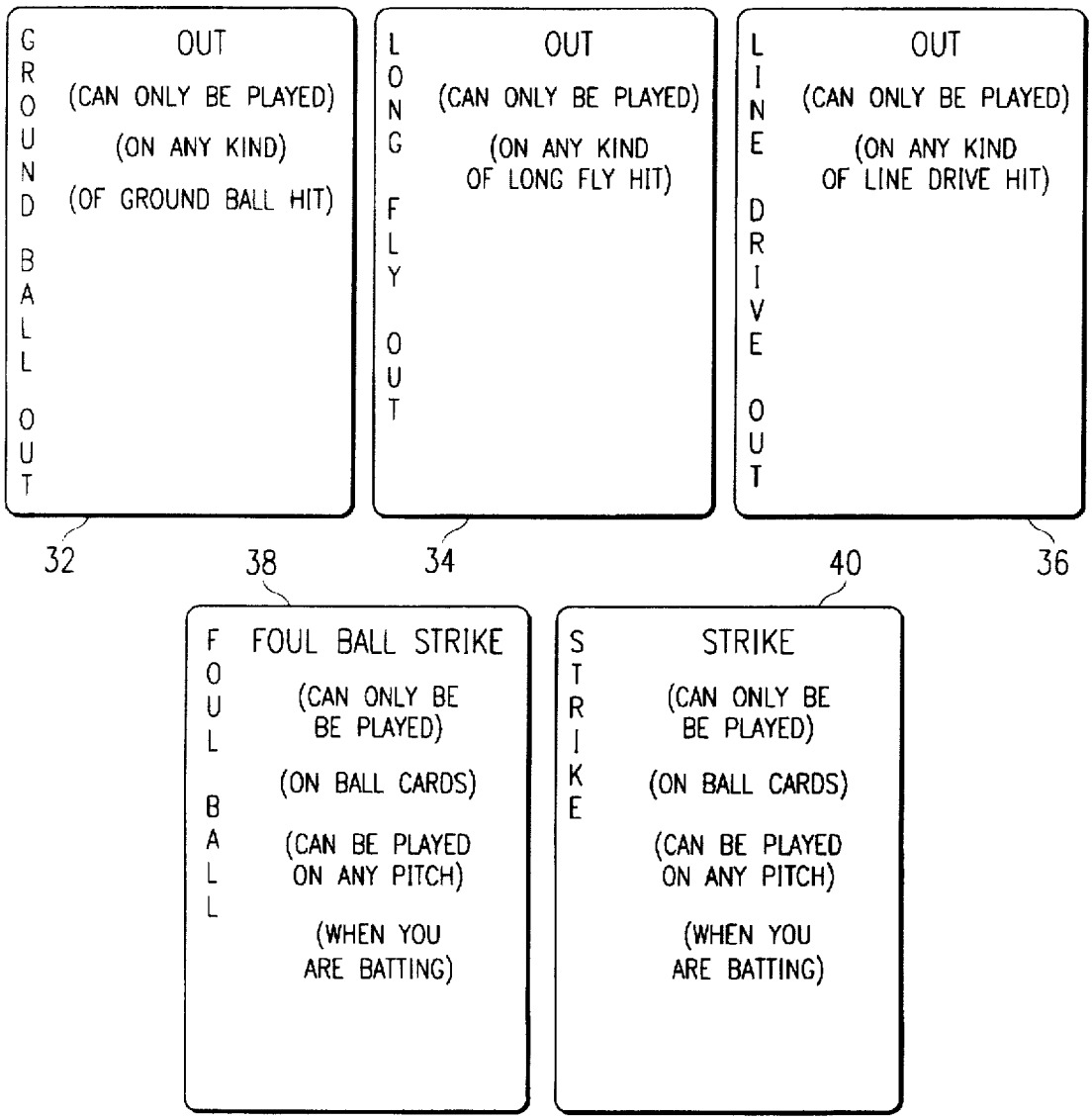
FIG. 4 is a pictorial view of the baseball defense cards.

In one embodiment of the present invention there is provided a method for playing a baseball board game. The method comprises providing a first deck of cards and a second deck of cards and shuffling the first deck of cards 2 with the second deck of cards 4 to produce a playing deck. A like plurality of cards are then dealt from the playing deck to each of a first player and a second player. The first deck of cards 2 comprises baseball offense cards as shown in FIG. 3 and baseball defense cards as shown in FIG. 4.

The baseball offense cards comprise baseball offense hit cards and baseball offense call cards. The baseball offense hit cards are selected from the group consisting of: ground ball single 5, ground ball infield hit cards 6, 6', ground ball drag bunt 8, ground ball base hit 10, 10', ground ball double cards 12, 12', long fly base hit cards 14, 14', long fly double 16, long fly triple 18, long fly home run 20, line drive base hit 22, line drive double 24, line drive triple 26, and line drive home run 28. The baseball offense call card is a ball card 30.

The baseball defense cards are selected from defense play cards and defense call cards. The defense play cards are selected from the group consisting of: ground ball out 32, long fly out 34, and line drive out 36. The defense call cards being selected from the group consisting of: foul ball call 38, and strike 40.

Figure 5:
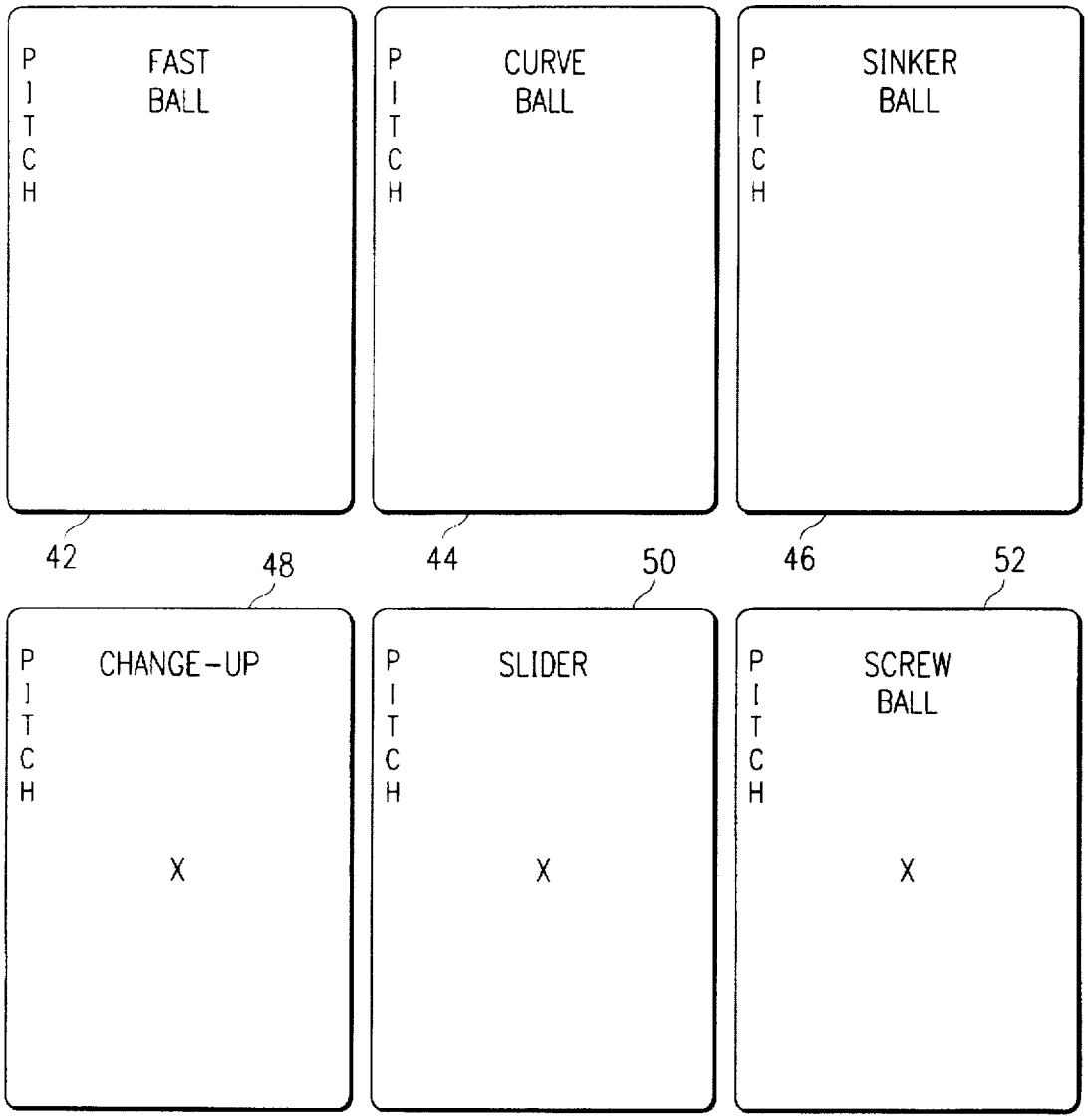
FIG. 5 is a pictorial view of the baseball pitching cards.
Figure 6C:
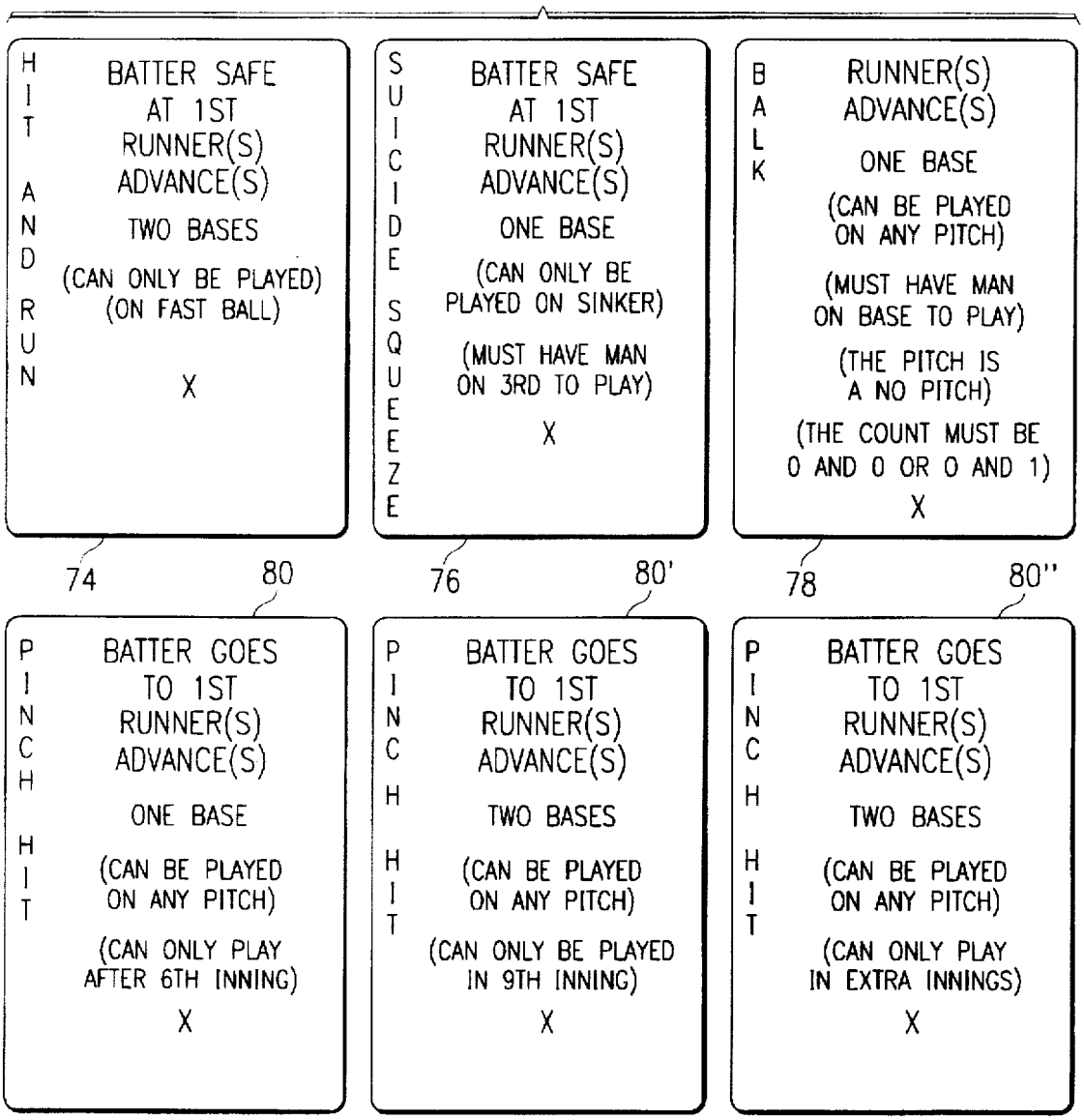
FIG. 6 is a pictorial view of the baseball situation cards.
Figure 6D:
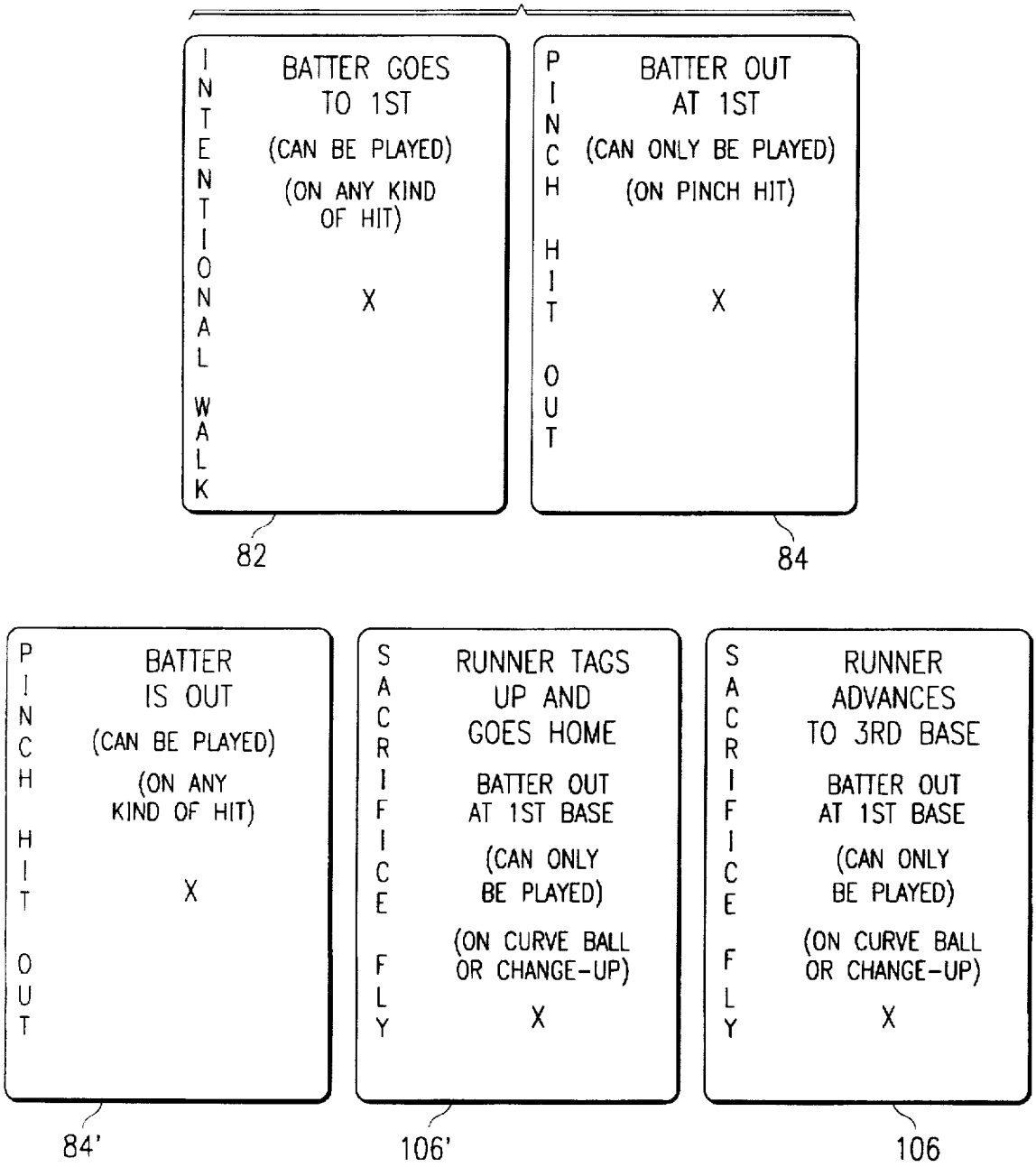

A beginning baseball offense player and a beginning baseball defense player are declared and a plurality of cards are dealt from a third deck 6 to the baseball offense player and the baseball defense player. The third deck 6 comprises a plurality of pitch cards and a plurality of situational play cards. (See FIGS. 5 and 6). The pitch cards are selected from the group consisting of: fast ball 42, curve ball 44, sinker 46, change-up 48, slider 50, and screw ball 52. The situational play cards being selected from the group consisting of: steal cards, out stealing cards 56, 56', double steal cards, double steal out cards, sacrifice cards 62, 62', 62", hit batsman 64, wild pitch 66, past ball 68, double play cards 70, 70', error cards, hit and run 74, suicide squeeze 76, balk 78, pinch hit 80, intentional walk 82, and pinch hit out 84.

A pitch card is played by the baseball defense player. (step i). A second card is then played responsively to the first card by the offense player.(step ii). A replacement card is drawn for the second card from the playing deck by the offense player.(step iii). The defense player elects whether to permit an outcome indicated by the second card to stand and discard a discard card or to play a third card responsively to the second card.(step iv). A replacement card is drawn by the defense player for the discard card or third card.(step v).

Figure 1:
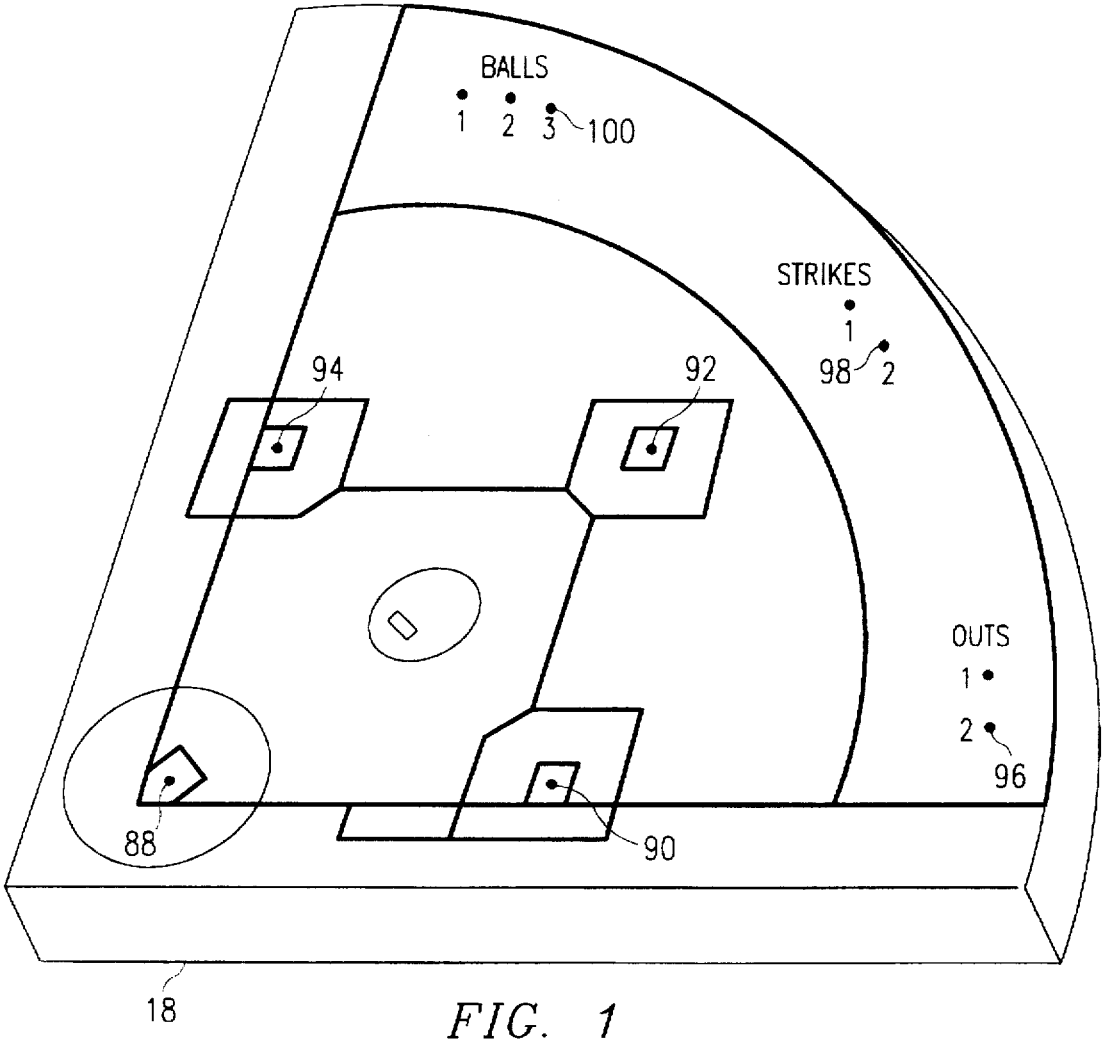
FIG. 1 is a perspective view of the game board.
Figure 2:
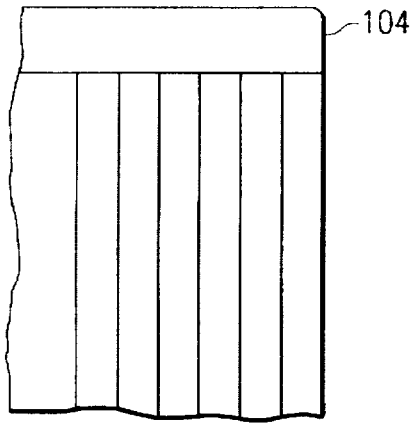
FIG. 2 is a perspective view of the tabular means to record play information.
Figure 8:
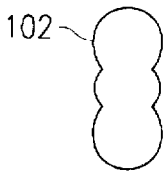
FIG. 8 is a pictorial view of a game piece.
Figure 9:
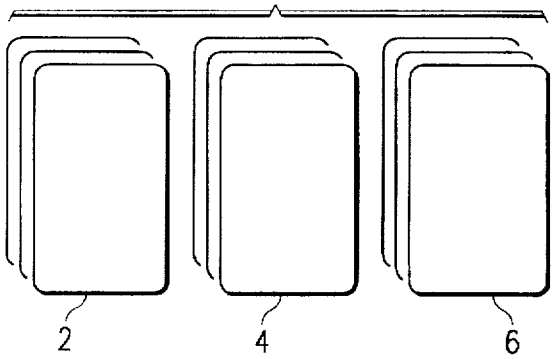
FIG. 9 is a pictorial view of the three decks of cards.

In a preferred embodiment, there is provided a baseball game board 18 having a representation of a baseball field therein including areas denoting home plate 88, first base 90, second base 92, third base 94, and areas to record outs 96, and a count constituted by strikes 98 and balls 100. An example of a game board is shown in FIG. 1. Game pieces 102 representing batters and base runners may also be provided. (See FIG. 8) The game pieces are also used as markers to record strikes, balls, outs, on the baseball game board 18. Score can be kept on a tabular means 104 to record strikes, balls, outs, runs and innings. (See FIG. 2). The status of the game is updated using the game pieces 102 as markers following the election by the defense player. (step vi).

Preferably, steps (i) through (vi) are repeated until the status of the game is three outs, and then roles are changed so that the baseball offense player becomes the baseball defense player and the baseball defense player becomes the baseball offense player.

Figure 7:
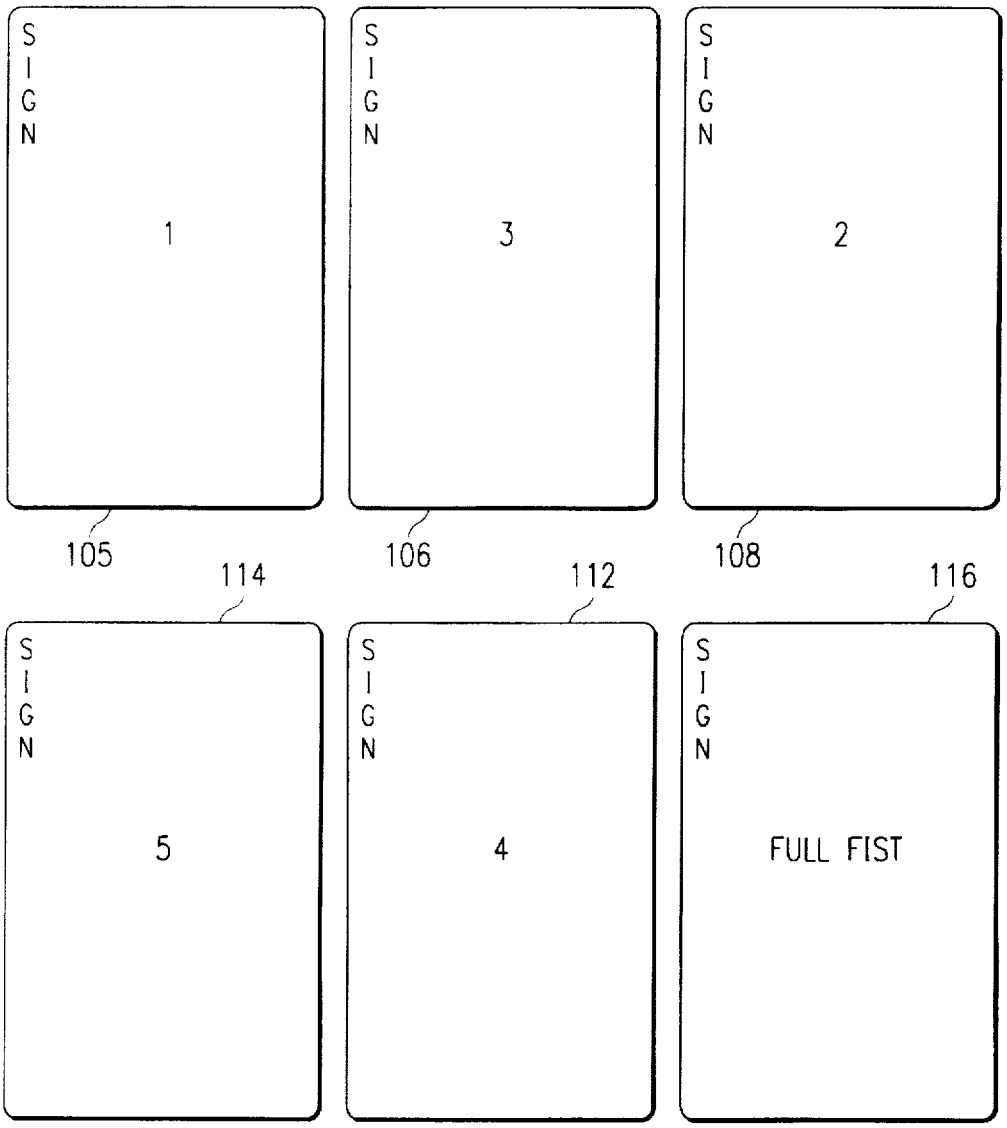
FIG. 7 is a pictorial view of the baseball catching cards.

The game can be played with four people. In this situation, the first player would consist of a first team having a first member and a second member and the second player would consist of a second team having a first member and a second member. When there are four players, a plurality of catcher cards can be used. (See FIG. 7). The catcher cards are selected from the group consisting of: 1 finger 105, 2 fingers 108, 3 fingers 106 4 fingers 112, 5 fingers 114, and full fist 116. The step of playing a second card responsively to the first card consists of playing one of the plurality of catcher cards by one of the first team members. The offensive team will use the catcher cards and as above, when the roles switch, each player or team will use the catcher cards.

In playing the game, preferably, the steal card is selected from the group consisting of: a runner steals card and a double steal card. The runner steals card can only be played where only one runner is on base and is selected from the group consisting of: runner steals any base 54, runner on first base steals second base 54', and runner on second base steals third base 54". The double steal card 60 is a runners steal any two bases card. In this situation, the runner steals any base card 54 can only be played responsively to a curve ball 44 card; the runner on first base steals second base card 54' can only be played responsively to a change-up card 48; and the runner on second base steals third base card 54" can only be played responsively to a screw ball 52 card.

In another preferred embodiment, the out stealing card is selected from the group consisting of a runner out cards and at least one double steal out card 56. The runner out card is selected from the group consisting of runner out stealing any base 58, runner out stealing second base 58', and runner out stealing third base 58", and the at least one double steal out card 56 is a lead runner out on double steal card. The runner out stealing any base card 58 can be played responsively to any steal card. The runner out stealing second base 58' card can only be played responsively to a runner on first base steals second base card 54'. The runner out stealing third base 58" card can only be played responsively to a runner on second base steals third base card 54", and the double steal out card 56 can be only played responsively to a runners steal any two bases card 60. In the event that a responsive out stealing card is not played in response to a steal card, then the pitch is a ball where the stealing card is a runner steals any base card 54, the pitch is a strike where the stealing card is a runner on first steals second base card 54', the pitch is a strike where the stealing card is a runner on second steals third base card 54".

In yet another preferred embodiment, a sacrifice card is selected from the group consisting of a sacrifice hit card 62, a sacrifice bunt card 62', and a sacrifice fly cards. In this embodiment, the sacrifice hit card 62 is a runner(s) advance (s), batter out at first base card, the sacrifice bunt card 62' is a runner(s) advance(s), batter out at first base card, and the sacrifice fly card is selected from the group consisting of a runner advances to third base, batter out at first base card 106, and a runner tags up and goes home, batter out at first base card 106'. In this embodiment, the sacrifice hit card 62 or sacrifice bunt card 62' cannot be played responsively to a fast ball 42 card or curve ball 44 card, and the sacrifice fly cards can only be played responsively to a curve ball 44 or change-up card 48.

In another preferred embodiment, the hit batsman 64 card is a batter advances to first base card. The wild pitch 66 card comprises a runner(s) advance(s) card which can not be played responsively to a fast ball 42 or change up card, and wherein the pitch is a ball. The past ball 68 card is a runner(s) advance(s) one base card which cannot be played responsively to a curve ball 44 or change-up 48 card, and wherein the pitch is a strike. The double play card can be a runners are out at first and second base card 70 which can only be played responsively to a ground ball hit card. The double play card can be a batter is out and man on first is doubled up card 70' which can only be played responsively to a line drive hit card.

A error card is selected from the group consisting of an infield error card 72, a 2 base error card 72' and an outfield error card 72". The infield error card 72 is a batter safe at first, runner(s) advance(s) one base card, which can only be played responsively to a fast ball 42 or curve ball 44 card, the 2 base error card 72' is a batter goes to second base, runner(s) advance(s) two bases card, which can only be played responsively to a fast ball 42 or curve ball 44 card, and the outfield error card 72" is a batter safe at first base, runner(s) advance(s) one base card, which can only be played responsively to a curve ball 44 or change-up 48 card.

The hit and run 74 card is a batter safe at first base, runner(s) advance(s) two bases card, which can only be played responsively to a fast ball 42 card. The suicide squeeze 76 card is a batter safe at first, runner(s) advance(s) one base card which can only be play responsively to a sinker 46 card when there is a man on third base. The balk 78 card is a runner(s) advance(s) one base, which can only be played when there is a man on base and the count is 0 and 0 or 0 and 1. The game can be played where the pitch does not count. The pinch hit card is selected from the group consisting of a batter goes to first base, runner(s) advance(s) one base card 80 which can only be played after the sixth inning, a batter goes to first base, runner(s) advance(s) two bases card 80', which can only be played in the ninth inning, and a batter goes to first base, runner(s) advance(s) two bases card 80", which can only be played in extra innings.

The pinch hit out card can be selected from the group consisting of a batter is out at first card 84 which can only be played responsively to a pinch hit card, and a batter is out card 84' which can only be played responsively to a hit card. The intentional walk 82 card is a batter goes to first card which can only be played responsively to a hit card. The ground ball single card 5 is a single, runner(s) advance(s) one base card, which can only be played responsively to a sinker 46 or slider 50 card.

A ground ball infield hit card 6, 6' can only be played responsively to a change-up 48 or screw ball 52 card and is selected from the group consisting of an infield hit, batter safe at first base, runner held at second base card 6 which can only be played when a single base runner is at second base, and an infield hit, batter safe at first base, runner held at third base card 6' which can only be played when a runner is on third base. The ground ball drag bunt 8 card is a drag bunt, batter safe at first base, runner(s) advance(s) one base card, which can only be played responsively to a change-up 48 or screw ball 52 card.

The ground ball base hit cards 10, 10' can only be played responsively to a sinker 46, slider 50, change-up 48 or screw ball 52 card and is selected from the group consisting of a base hit, runner(s) advance(s) one base card 10 and a batter goes to first base, lead runner(s) advance(s) two base card 10'. The ground ball responsive, 12' card can only be played responsively to a sinker 46, slider 50, change-up 48 or screw ball 52 card and is selected from the group consisting of a double, runner(s) advance(s) two base card 12, and double, runner advances three bases card 1240 which can only be played when a runner is on first base.

In play, the long fly base hit 14, 14' cards can only be played responsively to a curve ball 44 and is selected from the group consisting of a base hit, runner(s) advance(s) one base card 14, and a base hit, runner(s) advance(s) two bases card 14' which can only be played when there are two outs. The long fly double 16 card is a double, runner(s) advance(s) two bases card, which can only be played responsively to a curve ball 44. The long fly triple 18 card is a triple, runner(s) advance(s) three bases card, which can only be played responsively to a curve ball 44. The long fly home run 20 card is a home run, all runners score which can only be played responsively to a curve ball 44. The line drive base hit card 22 is a base hit, runner(s) advance(s) one base card, which can only be played responsively to a fast ball 42 card. The line drive double card 24 is a double, runner(s) advance (s) two bases card, which can only be played responsively to a fast ball 42 card. The line drive triple card 26 is a triple, runner(s) advance(s) three bases card, which can only be played responsively to a fast ball 42 card. The line drive home run card 28 is a home run, all runners score, which can only be played responsively to a fast ball 42 card.

A ball card 30 can be played responsively to any pitch card. The ground ball out 32 card can only be played responsively to a ground ball hit card. The long fly out 34 card can only be played responsively to a long fly hit card. The line drive out 36 card can only be played responsively to a line drive hit card. The strike card 40 can be played responsively to any ball card or responsively to any pitch card by a player at bat. The foul ball call card is a foul ball strike card 38 which can be played responsively to any ball card or responsively to any pitch card by the baseball offense player.

In another embodiment of the present invention, there is provided a game system having a baseball game board 86 as described above. Game pieces 102 representing batters and base runners and markers to record strikes, balls, and outs on the baseball game board 86 are also provided. There is a tabular means 104 to record strikes, balls, outs, runs and innings. A plurality of cards comprising baseball offense cards, baseball defense cards pitch cards and situational play cards as described above is provided. At least a portion of the plurality of cards carries instructions for their use to replicate the progress of a baseball game.

In a preferred embodiment, the plurality of cards comprises a first deck of cards 2 containing the baseball offense cards having a first color and a second deck of cards 4 containing the baseball defense cards having a second color and a third deck of cards 6 containing the pitch cards and the situational play cards having a combination of the first color and second color. The baseball offense cards can comprise baseball offense hit cards and baseball offense call cards like those described above. The baseball defense cards can comprise defense play cards and defense call cards like those described above.

In a preferred embodiment of the present invention, there are three decks of cards. The first deck of cards 2 has the offense playing cards consisting of: 3 Ground Ball Singles, 2 Ground Ball Infield Hits, 1 Ground Ball Drag Bunt, 4 Ground Ball Base Hits, 5 Ground ball doubles, 2 long fly base hits, 7 Long Fly Doubles, 1 Triple, 2 Home Runs, and 12 balls, for a total of 54 offense playing cards.

The second deck has the defensive playing hand consisting of: 15 Ground Ball Outs, 12 Long Fly Outs, 15 Line Drive Outs, 3 Foul Balls, 9 strikes, for a total of 54 defense playing cards.

The third deck of cards 6 has pitching cards, catching cards and situation play cards. The pitching cards represent 6 fast balls, 3 curve balls, 3 sinkers, 2 change-ups, 2 sliders, and 2 screw balls for a total of 18 pitches. The catching cards represent 1 finger, 2 fingers, 3 fingers, 4 fingers, 5 fingers, and one full fist, for a total of 6 catcher signs. The situation cards comprise 3 steals, 3 out stealing, 1 Double steal, 2 Double steal Outs, 1 Sacrifice Hit, 1 Sacrifice Bunt, 2 Sacrifice Fly, 1 Hit batsman, 1 Wild pitch, 1 Past ball, 2 Double Plays, 1 Infield Error, 1 (2) Base Error, 1 Outfield Error, 1 Hit & Run, 1 Suicide squeeze, 1 Balk, 3 Pinch Hits, 1 Intentional walk, and 2 Pinch hit Outs, for a total of 30 situational play cards.

Although the present invention is described and illustrated above with detailed reference to the preferred embodiment, the invention is not limited to the details of such embodiment but is capable of numerous modifications, by one of ordinary skill in the art, within the scope of the following claims.

What is claimed is:

1. A method of simulating a baseball game comprising the following steps:

providing a first deck of cards and a second deck of cards;

shuffling the first deck of cards with the second deck of cards to produce a shuffled deck;

dealing a like plurality of cards from the shuffled deck to each of a first player and a second player, the first deck of cards comprising baseball offense cards and baseball defense cards, the baseball offense cards comprising baseball offense hit cards and baseball offense call cards, the baseball offense hit cards each having a type of offense play selected from the group consisting of:

ground ball single, ground ball infield hit, ground ball drag bunt, ground ball base hit, ground ball double, long fly base hit, long fly double, long fly triple, long fly home run, line drive base hit, line drive double, line drive triple, and line drive home run, the offense call card being a ball card, the baseball defense cards being selected from defense play cards and defense call cards, the defense play cards each having a type of defense play selected from the group consisting of:

ground ball out, long fly out, and line drive out, the defense call cards being selected from the group consisting of:

foul ball call, and strike, declaring a beginning baseball offense player and a beginning baseball defense player;

dealing a plurality of cards from a third deck to the baseball offense player and the baseball defense player, said third deck comprising a plurality of pitch cards and a plurality of situational play cards, the pitch cards each having a type of pitch delivered by a pitcher selected from the group consisting of:

fast ball, curve ball, sinker, change-up, slider, and screw ball, the situational playing cards having offense situational play cards each having a type of offense situation selected from the group consisting of:

steal, double steal, sacrifice, hit batsman, wild pitch, past ball, error, hit and run, suicide squeeze, pinch hit, the situational play cards also having defense situational play cards each having a type of defense situation selected from the group consisting of:

out stealing, double steal out, double play, intentional walk, pinch hit out, said offense cards and said offense situational cards each having instructions advancing the batter and/or runner a number of bases, each of said offense cards and offense situational cards also having an instruction listing certain said types of pitches delivered by a pitcher which would advance the batter and/or runner.

said defense play cards and said defense situational cards each having an instruction indicating that a batter and/or runner is out, each of said defense playing cards and said defense situational cards also having an instruction listing one of said offense play or offense situation which would indicate that the batter and/or runner is out, (i) playing pitch card, wherein the first card is played by the baseball defense player;

(ii) playing a second card responsively to the first card, wherein the second card, an offense card or an offense situational card, is played by the offense player wherein the offense player attempts to play an offense card or an offense situational card which lists the type of pitch delivered on said played pitch card in order to advance the batter and/or runner;

(iii) drawing a replacement card for the second card from the second deck, wherein the replacement card is drawn by the offense player;

(iv) electing whether to permit an outcome indicated by the second card to stand and discard a discard card or to play a third card responsively to the second card, wherein the election is made by the defense player, wherein if the defense player elects to play a third card, the third card is a defense play card or defense situational card which lists the type of offense play or offense situation on said second played card in order to indicate that the batter and/or runner is out; and (v) drawing a replacement card for the discard card or third card, wherein the replacement card is drawn by the defense player.

2. A method as in claim 1 further comprising providing a baseball game board having a representation of a baseball field therein including areas denoting home plate, first base, second base, third base, and areas to record outs, and a count constituted by strikes and balls;

providing game pieces representing batters and base runners, and markers to record strikes, balls, outs, on the baseball game board;

providing a tabular means to record strikes, balls, outs, runs and innings;

(vi) updating a status of the game using the game pieces as markers following the election by the defense player.

3. A method as in claim 2, further comprising repeating steps (i) through (vi) are repeated until the status of the game is three outs, and then changing the roles so that the baseball offense player becomes the baseball defense player and the baseball defense player becomes the baseball offense player.

4. A method as in claim 2, wherein the steal card is selected from the group consisting of a runner steals card and a double steal card, wherein the runner steals card can only be played where only one runner is on base and is selected from the group consisting of:

runner steals any base, runner on first base steals second base, and runner on second base steals third base, and the double steal card is a runners steal any two bases card.

5. A method as in claim 4, wherein the runner steals any base card can only be played responsively to a curve ball card, the runner on first base steals second base card can only be played responsively to a change-up card, and the runner on second base steals third base card can only be played responsively to a screw ball card.

6. A method as in claim 2, wherein the out stealing card is selected from the group consisting of a runner out card and at least one double steal out card, wherein the runner out card is selected from the group consisting of:

runner out stealing any base, runner out stealing second base, and runner out stealing third base, and the at least one double steal out card is a lead runner out on double steal card.

7. A method as in claim 6, wherein the runner out stealing any base card can be played responsively to any steal card, the runner out stealing second base card can only be played responsively to a runner on first base steals second base card, the runner out stealing third base card can only be played responsively to a runner on second base steals third base card, and the lead runner out card can be only played responsively to a runners steal any two bases card.

8. A method as in claim 7, wherein in the event that a responsive out stealing card is not played in response to a steal card, then the pitch is a ball where the stealing card is a runner steals any base card, the pitch is a strike where the stealing card is a runner on first steals second base card, the pitch is a strike where the stealing card is a runner on second steals third base card.

9. A method as in claim 2 wherein the sacrifice card is selected from the group consisting of a sacrifice hit card, a sacrifice bunt card, and a sacrifice fly card.

10. A method as in claim 9 wherein the sacrifice hit card is a runner(s) advance(s), batter out at first base card, the sacrifice bunt card is a runner(s) advance(s), batter out at first base card; and the sacrifice fly card is selected from the group consisting of a runner advances to third base, batter out at first base card, and a runner tags up and goes home, batter out at first base card.

11. A method as in claim 10 wherein the sacrifice hit card or sacrifice bunt card cannot be played responsively to a fast ball card or curve ball card, and the sacrifice fly card can only be played responsively to a curve ball or change up card.

12. A method as in claim 2 wherein the hit batsman card is a batter advances to first base card.

13. A method as in claim 2 wherein the wild pitch card cards comprise a runner(s) advance(s) card which can not be played responsively to a fast ball or change up card, and wherein the pitch is a ball.

14. A method as in claim 2 wherein the past ball card is a runner(s) advance(s) one base card which cannot be played responsively to a curve ball or change-up card, and wherein the pitch is a strike.

15. A method as in claim 2 wherein the double play card is a runners are out at first and second base card which can only be played responsively to a ground ball hit card.

16. A method as in claim 2 wherein the double play card is a batter is out and man on first is doubled up card which can only be played responsively to a line drive hit card.

17. A method as in claim 2 wherein the error card is selected from the group consisting of an infield error card, a 2 base error card and an outfield error card.

18. A method as in claim 2 wherein the infield error card is a batter safe at first, runner(s) advance(s) one base card, which can only be played responsively to a fast ball or curve ball card, the 2 base error card is a batter goes to second base, runner(s) advance(s) two bases card, which can only be played responsively to a fast ball or curve ball card, and wherein the outfield error card is a batter safe at first base, runner(s) advance(s) one base card, which can only be played responsively to a curve ball or change-up card.

19. A method as in claim 2 wherein the hit and run card is a batter safe at first base, runner(s) advance(s) two bases card, which can only be played responsively to a fast ball card.

20. A method as in claim 2 wherein the suicide squeeze card is a batter safe at first, runner(s) advance(s) one base card which can only be play responsively to a sinker card when there is a man on third base.

21. A method as in claim 2 wherein the balk card is a runner(s) advance(s) one base, which can only be played when there is a man on base and the count is 0 and 0 or 0 and 1.

22. A method as in claim 21 wherein the pitch does not count.

23. A method as in claim 2 wherein the pinch hit card is selected from the group consisting of a batter goes to first base, runner(s) advance(s) one base card which can only be played after the sixth inning, a batter goes to first base, runner(s) advance(s) two bases card, which can only be played in the ninth inning, and a batter goes to first base, runner(s) advance(s) two bases card, which can only be played in extra innings.

24. A method as in claim 2 wherein the pinch hit out card is selected from the group consisting of a batter is out at first card which can only be played responsively to a pinch hit card, and a batter is out card which can only be played responsively to a hit card.

25. A method as in claim 2 wherein the intentional walk card is a batter goes to first card which can only be played responsively to a hit card.

26. A method as in claim 2 wherein the ground ball single card is a single, runner(s) advance(s) one base card, which can only be played responsively to a sinker or slider card.

27. A method as in claim 2 wherein the ground ball infield hit card can only be played responsively to a change-up or screw ball card and is selected from the group consisting of an infield hit, batter safe at first base, runner held at second base card which can only be played when a single base runner is at second base, and an infield hit, batter safe at first base, runner held at third base card which can only be played when a runner is on third base.

28. A method as in claim 2 wherein the drag bunt card is a drag bunt, batter safe at first base, runner(s) advance(s) one base card, which can only be played responsively to a change-up or screw ball card.

29. A method as in claim 2 wherein the ground ball base hit card can only be played responsively to a sinker, slider, change-up or screw ball card and is selected from the group consisting of a base hit, runner(s) advance(s) one base card and a batter goes to first base, lead runner(s) advance(s) two base card.

30. A method as in claim 2 wherein the ground ball double card can only be played responsively to a sinker, slider, change-up or screw ball card and is selected from the group consisting of a double, runner(s) advance(s) two base card, and double, runner advances three bases card which can only be played when a runner is on first base.

31. A method as in claim 2 wherein the long fly base hit card can only be played responsively to a curve ball and is selected from the group consisting of a base hit, runner(s) advance(s) one base card, and a base hit, runner(s) advance (s) two bases card which can only be played when there are two outs.

32. A method as in claim 2 wherein the long fly double card is a double, runner(s) advance(s) two bases card, which can only be played responsively to a curve ball.

33. A method as in claim 2 wherein the long fly triple card is a triple, runner(s) advance(s) three bases card, which can only be played responsively to a curve ball.

34. A method as in claim 2 wherein the home run card is a home run, all runners score which can only be played responsively to a curve ball.

35. A method as in claim 2 wherein the line drive base hit card is a base hit, runner(s) advance(s) one base card, which can only be played responsively to a fast ball card.

36. A method as in claim 2 wherein the line drive double card is a double, runner(s) advance(s) two bases card, which can only be played responsively to a fast ball card.

37. A method as in claim 2 wherein the line drive triple card is a triple, runner(s) advance(s) three bases card, which can only be played responsively to a fast ball card.

38. A method as in claim 2 wherein the line drive home run card is a home run, all runners score, which can only be played responsively to a fast ball card.

39. A method as in claim 2 wherein a ball card can be played responsively to any pitch card.

40. A method as in claim 2 wherein the ground ball out card can only be played responsively to a ground ball hit card.

41. A method as in claim 2 wherein the long fly out card can only be played responsively to a long fly hit card.

42. A method as in claim 2 wherein the line drive out card can only be played responsively to a line drive hit card.

43. A method as in claim 2 wherein the strike card can be played responsively to any ball card or responsively to any pitch card by a player at bat.

44. A method as in claim 2 wherein the foul ball card is a foul ball strike card which can be played responsively to any ball card or responsively to any pitch card by the baseball offense player.

45. A method as in claim 1, further comprising providing a plurality of catcher cards, wherein the first player comprises a first team having a first member and a second member and the second player comprises a second team having a first member and a second member.

46. A method as in claim 45, wherein the plurality of catcher cards being selected from the group consisting of:

1 finger, 2 fingers, 3 fingers, 4 fingers, 5 fingers, full fist, and wherein the step of playing a second card responsively to the first card consists of playing one of said plurality of catcher cards by one of the first team members.

47. A game system comprising:

a baseball game board having a representation of a baseball field therein including areas denoting home plate, first base, second base, third base, and areas to record outs, and a count constituted by strikes and balls;

game pieces representing batters and base runners and markers to record strikes, balls, and outs on the baseball game board;

a tabular means to record strikes, balls, outs, runs and timings; and a plurality of cards comprises a first deck of cards containing baseball offense cards having a first color; and baseball defense cards having a first color and a second deck of cards containing pitch cards and situational play cards and having a second color, wherein the baseball offense cards comprise baseball offense hit cards and baseball offense call cards, and the baseball defense cards comprise defense play cards and defense call cards, the baseball offense cards being selected from the baseball offense hit cards and the offense call cards, the baseball offense hit cards each having a type of offense play, the baseball defense cards being selected from defense play cards and defense call cards.

* * * * *